United States Patent [19]

Gramera

[11] 4,335,820

[45] Jun. 22, 1982

[54] MAGNETICALLY-AUTOMATED UNCOUPLING SYSTEM FOR MODEL RAILROADS

[76] Inventor: Robert E. Gramera, 10420 W. 44th Ave., Apt. 2A, Wheatridge, Colo. 80033

[21] Appl. No.: 183,301

[22] Filed: Sep. 2, 1980

Related U.S. Application Data

[63] Continuation of Ser. No. 933,420, Aug. 14, 1978, abandoned.

[51] Int. Cl.[3] ..... B61G 3/00; A63H 19/18

[52] U.S. Cl. ..... 213/75 TC; 213/75 D; 213/211; 46/216

[58] Field of Search ..... 213/75 R, 75 D, 75 TC, 213/211, 212; 46/216

[56] References Cited

U.S. PATENT DOCUMENTS

| | | | |
|---|---|---|---|
| 3,069,023 | 12/1962 | Ross | 213/211 |
| 3,111,229 | 11/1963 | Edwards et al. | 213/212 |
| 3,115,255 | 12/1963 | Edwards et al. | 213/211 |
| 3,117,676 | 1/1964 | Edwards et al. | 23/211 |
| 3,469,713 | 9/1969 | Edwards et al. | 213/75 TC |
| 3,564,766 | 3/1971 | Edwards et al. | 213/75 TC |
| 3,942,648 | 3/1976 | Edwards et al. | 213/212 |

OTHER PUBLICATIONS

"Electromagnetic Ramp for Kadee Couplers", Otto H. Schade, Jr., *Model Railroader,* pp. 54, 55, (1961).

*Primary Examiner*—Randolph A. Reese
*Attorney, Agent, or Firm*—David H. LeRoy

[57] ABSTRACT

A magnetically automated delayed uncoupling system consisting of a knuckle positioned magnet actuated coupler and a parallel outside-the-track magnetic force field which permits use of ferromagnetic train wheels without wobble and provides delayed uncoupling and coupling. The improved system is compatible with hook type couplers when used in combination therewith.

4 Claims, 18 Drawing Figures

FIG. 11 PRIOR ART
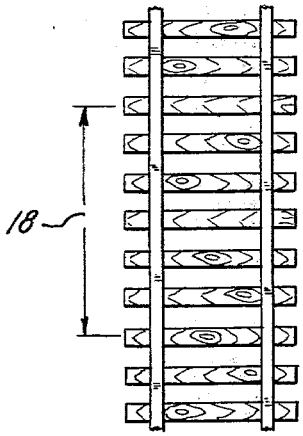
FIG. 12
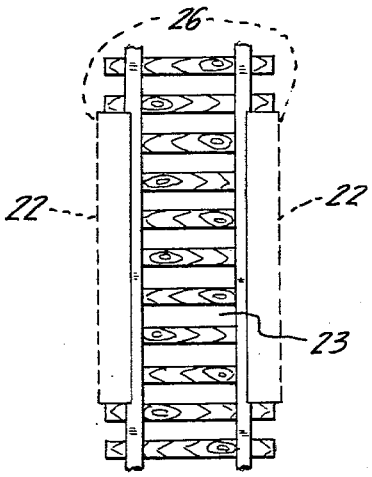
FIG. 13 PRIOR ART
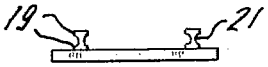
FIG. 14
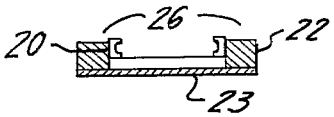
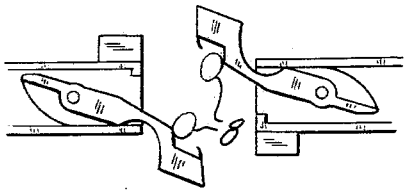
FIG. 15A
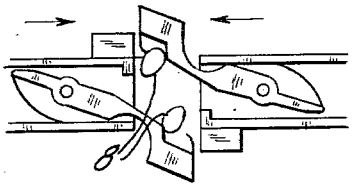
FIG. 15B
FIG. 15C
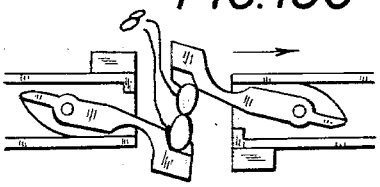
FIG. 15D
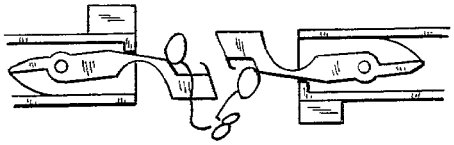

MAGNETICALLY-AUTOMATED UNCOUPLING SYSTEM FOR MODEL RAILROADS

This is a continuation, of application Ser. No. 933,420 filed Aug. 14, 1978, now abandoned.

FIELD OF INVENTION

This invention relates to a system for magnetically uncoupling and coupling model railroad cars.

BACKGROUND OF INVENTION

The model railroader has had various couplers available for use in coupling and uncoupling of model rail or freight cars. Of these, the most popular coupler has been a hook type coupler or a variation thereof. These couplers have been used with all types of railroad systems, the most popular models adapted for "HO" gauge or "N" gauge track.

In an attempt to provide remote control and authenticity, magnetic coupling and uncoupling systems were developed, as exemplified in U.S. Pat. No. 3,111,229 and U.S. Pat. No. 3,115,255. Delayed action magnetic couplers were introduced to overcome inadequateness of these prototypes, as shown in U.S. Pat. Nos. 3,117,676 and 3,469,713. In these later attempts, alterations of the housing pivot, shank and knuckle were made.

A difficulty with conventional magnetic couplers exists with the uncoupling pin which extends downward from the coupler, perpendicular to the track rail surface and the "between-the-track" arrangement of the magnetic field. If the downward extended pin comes too close to the surface of the rail, it oftentimes hits the side of the track, snags at switch points, frogs on rerailing ramps or even within its own uncoupling ramp, causing inadvertent uncoupling and derailments of the rolling stock. As a result of this basic problem, some model railroaders simply cut the pin from the coupler and then use hand uncoupling to effect separation or uncoupling of rolling stock when it is desired, which is far from being prototypical.

Another unsolved problem resides in the incompatibility of a magnetic coupler system with conventional hook-horn coupler design which is available on rolling stock, such as "HO" gauge in ready-to-run or kit form. These conventional couplers do not operate by delayed uncoupling, which is defined as the means whereby rolling stock can be uncoupled, spotted and released at any desired location on a model railroad layout from a single remote uncoupling site. If the model railroader wishes to convert a conventional hook-horn type coupler to a delayed uncoupling system, he must also replace the conventional couplers, possibly the coupler pocket housings, and in some cases the entire truck frame, which may include ferromagnetic wheels and/or axles. This is a time consuming disadvantage that also adds to the cost of rolling stock.

SUMMARY OF THE INVENTION

This invention is directed to an improved magnetically-automated delayed uncoupling system which comprises a knuckle positioned magnet and an outside-the-rail positioned magnetic field for a full opening activation of the uncoupling procedure.

An advantage of the instant invention is an economically simple means to produce an improved magnetically-automated delayed uncoupling system for model railroads. The uncoupling system of the instant invention provides also for simple conversion of the conventional hook type coupler to a magnet-actuated coupler. According to the instant invention, the magnetic coupler may be preferably activated by a magnetic force field from magnets positioned outside the rail track to facilitate said coupler to uncouple: (1) from a conventional coupler, and (2) from a companion magnet-actuated coupler by a delayed mechanism. A method is provided whereby rolling stock can be uncoupled, spotted and released at any desired uncoupling site. The improved coupler system of the instant invention will reliably recouple with various conventional couplers and allow recoupling with the heavier springs associated with conventional hook type couplers.

This versatility of recoupling is accomplished with a specifically designed magnetic force field, without replacement of ferromagnetic wheels, axles and/or truck frames on rolling stock with costly non-ferromagnetic substitutes. One unique feature of the magnetic coupler system of this invention is the magnetic force field which is specific for the knuckle positioned magnet-actuated coupler and will not activate delayed uncoupling of other currently available magnet-actuated couplers. Another distinctive feature of the instant system is that no other magnetic force field design, except the outside-the-track force field described in this invention, will facilitate the magnet-actuated coupler of this invention to respond to delayed uncoupling. The combination of the magnet-actuated coupler with the outside-the-track magnetic force field, therefore, provides a unique magnetic coupler system.

BRIEF DESCRIPTION OF THE DRAWINGS

The invention will be more readily understood by referring to the accompanying specifications, consisting of drawn figures and the detailed description, which are intended as illustrative of the invention rather than as limiting the invention to the specific details herein set forth.

FIGS. 2, 4 and 5 are the overall, side and front views, respectively, of the knuckle positioned magnetic-actuated coupler according to this invention.

FIGS. 11 and 13 are the top and front views section, respectively, of the rail track.

FIGS. 12 and 14 are the top and front views, respectively, of the rail track containing the preferred parallel separate bar magnets in place, constituting the magnetic force field.

FIGS. 15-A, 15B, 15C and 15D is a top view illustration of the delayed uncoupling mechanism in action according to the features of this invention.

DETAILED DESCRIPTION OF THE INVENTION

Figure 1:
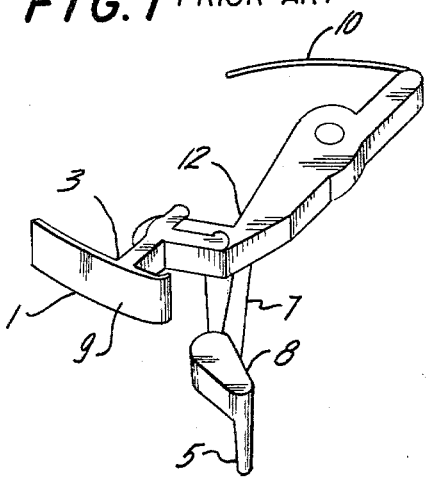
FIG. 1 PRIOR ART
FIGS. 1, 3 and 5 are the overall, side and front views, respectively, of a conventional hook type coupler.
Figure 2:
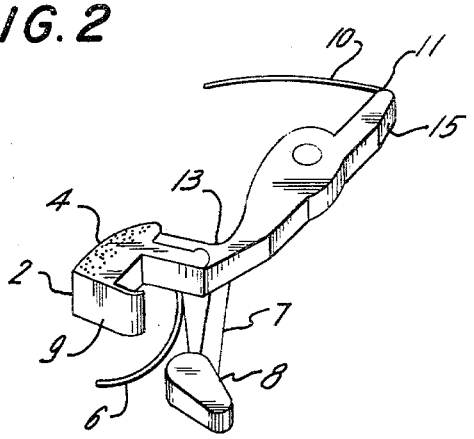
Figure 3:
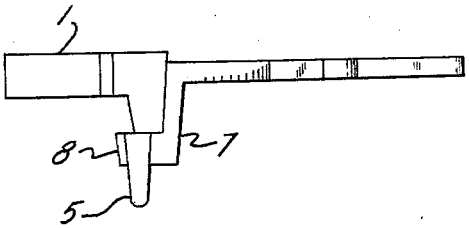
FIG. 3 PRIOR ART
Figure 4:
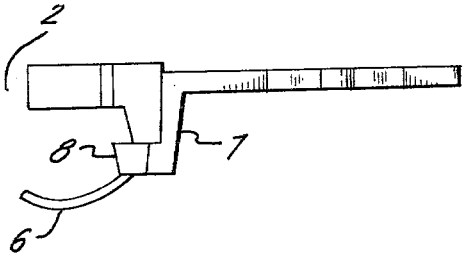
Figure 5:
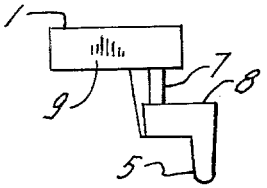
FIG. 5 PRIOR ART
Figure 6:
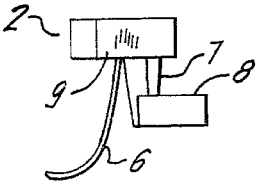
Figure 7:
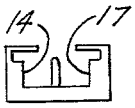
FIG. 7 PRIOR ART
FIGS. 7 and 9 are the front and top views, respectively, of a conventional coupler pocket housing.

To make the instant invention readily understandable and distinguishable, a comparison to a conventional coupler is provided. A conventional coupler, commonly used on "HO" gauge rolling stock is illustrated in FIGS. 1, 3 and 5. As depicted in FIGS. 2, 4 and 6, the instant invention closely resembles the prototype in its physical appearance. This is shown wherein the length of the horn 1 is reduced to achieve the apearance of tip 2. Preferably gap 3 is filled with a plastic molding material and shaped to a knuckle-like appearance 4 being defined by the outer end of the draw bar. The uncoupling pin 5, located on the conventional coupler may be completely removed for operational purposes of this invention. A curved ferromagnetic component 6, best viewed in FIGS. 4 and 6, may be inserted into a predrilled hole in the underside portion of knuckle 4, adjacent to post 7, attached to bypass 8. The curved ferromagnetic component 6 may be angled toward the tip 2, best viewed in FIG. 6. Preferably the shape and position of the ferromagnetic component 6, attached to knuckle 4 of the coupler, adds to the prototypical appearance of the coupler with the preferred curve for ferromagnetic component 6 closely resembling the air hose on life size rolling stock. For the most effective magnetic pull on the coupler, the distance between the bottom of the ferromagnetic component 6 and the surface of the track is preferably slightly less than about 1/32 inch. The position and angle of the curved ferromagnetic component 6 accomplishes cooperation with the bar magnet 22, best viewed in FIGS. 12 and 14, positioned on the outside face of the rail, such that the tip of the curved ferromagnetic component 6 operates in a manner that facilitates delayed uncoupling, as further illustrated in FIG. 15-A.

The off-centered position and angle of the ferromagnetic component 6 of the knuckle positioned magnet-actuated coupler of this invention does not interfere with pin 5 of a conventional coupler when the two couplers are used together in a recoupling operation. Interference between the ferromagnetic component 6 with the pin 5 of a conventional coupler is prevented since face 9 of the instant coupler engages with the opposite face of the conventional coupler allowing component 6 to slide past pin 5 as the couplers engage in recoupling.

In order for the bar magnets 22, shown in FIGS. 12 and 14, to active and attract the knuckle positioned magnet-actuated coupler to a full open position, according to this invention, the tension of the attached spring 10 of FIG. 2 may be reduced, preferably by reduction in the thickness of the spring as shown at position 11. The tension of the instant spring must be such that bar magnet 22 moves the coupler to a point where bypass 8 on one coupler clears the bypass of its companion coupler, illustrated in FIG. 15-B and C, to facilitate delayed uncoupling. Moreover, the tension of spring 10 is at the same time sufficient to allow recoupling with conventional stiff sprung couplers.

Figure 8:
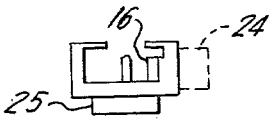
FIGS. 8 and 10 are the front and top views, respectively, of suitable coupler pocket housing for this invention.
Figure 9:
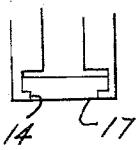
FIG. 9 PRIOR ART
Figure 10:
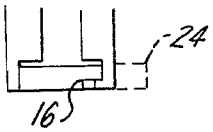

In comparison to conventional couplers, the forward portion of the draw bar immediately behind knuckle 12 may have cut out sections as shown at position 13 and position 15. Therefore, the knuckle positioned magnetic coupler can open to its maximum in the coupler pocket housing so that delayed uncoupling is achieved, as shown in the operational sequence A, B and C, depicted in FIG. 15. Conventional couplers may vary for individual manufacturing design of the draw bar, leaf spring and respective coupler pocket housing. As shown in FIGS. 2 and 4, the bypass 8 on one coupler does not interfere with the bypass on the opposite companion coupler. In this invention a thin shim 16, FIGS. 8 and 10 may be inserted into the coupler pocket housing at point 17 to arrest the coupler in a more centered position within the coupler pocket housing when in a ready to couple position outside of the magnetic force field, as illustrated in FIG. 15-D.

When the knuckle-positioned magnetic coupler reenters the magnetic force field, magnetic lines of force actively engage the ferromagnetic component 6, drawing the coupler laterally outward from the over the outside edge of the rail to a maximum open position to facilitate uncoupling by a delayed mechanism. Neither a magnetic field placed between the track rails or a wider magnetic field placed directly beneath the track ties will activate the thus arranged knuckle-positioned magnetic coupler to uncouple by delayed action. An outwardly aligned magnetic force field 26 of this invention will, however, accomplish the uncoupling.

The unique design of the magnetic force field 26, arranged specifically to actuate the herein described knuckle positioned magnetic coupler for delayed uncoupling, is further illustrated in the embodiments of FIGS. 12 and 14. In a preferred embodiment of the instant invention, bar magnets are positioned flat against the track in an outside position. It is an essential feature of this invention that an outside track position is held for proper concentration of the magnetic force. For descriptive purposes, several tie ends 18, may be viewed in FIG. 11, as cut away from the track shown in FIG. 12, with cut-out at position 19 to 20 of the track rail and parallel magnets 22 affixed flush to the rail 21, as shown in FIGS. 13, and 14. Preferably, a 3/16 inch bar magnet 22 is fitted on the outside of the track with the surface of the bar magnet even with the surface of the rail. The strength of the bar magnets and positioning on the track work is closely controlled so that the magnetic force field 26 will (1) allow the use of rolling stock equipped with ferromagnetic axles, wheels and/or truck frames and (2) retain a normal track appearance. The uncoupling site is not easily noticed on a railroad layout when the preferred bar magnets are inserted into the track system "as is" or are concealed in rerailing, crossover and/or switch track assemblies. If too powerful magnets are used, the first advantage no longer applies, since rolling stock equipped with ferromagnetic wheels will "wobble" in a magnetic force field and cause problems in delayed uncoupling. If physically larger magnets are used, the second advantage is lost since these would be easily noticed on the railroad track layout and would be difficult to conceal in rerailing, crossover or switch track assemblies.

In a preferred arrangement of this invention, a 1/32 inch thick steel plate 23, is placed under two bar magnets 22 to cover an area that extends from the outer edge of one bar magnet across and under the ties, over to the outer edge of the opposite bar magnet, as depicted in FIGS. 12 and 14. Positioning of the steel plate 23, directionally orients and concentrates the magnetic force lines to be outwardly displaced over each rail to facilitate full opening of the wide pivot radius of the knuckle positioned magnetic coupler for delayed uncoupling. The bar magnet 22, can be metal, ceramic and/or a plastic material and the magnetic field 26, may be either a permanent one or an electro-magnetic type, preferably activated by means of an automatic push button or switch device. If bar magnets 22, are in direct contact with the track rail at the tee stem positions 21 of FIG. 14, and a steel plate 23 connects both bar magnets 22, it is necessary to insert an insulator, such as a microthin strip of plastic (polyethylene) non-conductor between the bottom of each bar magnet 22 and the steel plate 23 to avoid a short circuit between the plus and minus track rails and, particularly if electrically conducting bar magnets other than the plastic types are used in the system. The unique design features of the magnetic force field 26, is specific for the knuckle-positioned magnetic coupler and will not activate delayed uncoupling of available commercial magnet-actuated couplers.

The overall mechanism for delayed uncoupling employing this system is best viewed sequentially in A, B, C, and D of FIG. 15. When rolling stock is pulled across the magnet force field, the couplers remain engaged. However, when the rolling stock is stopped over the magnetic force field and slack is allowed between the couplers, as shown in FIG. 15-A, the couplers disengage and withdraw to their outer respective rail tracks as shown in FIG. 15-A. When the rolling stock is reversed, FIG. 15-B, the bypass 8 on one coupler passes its companion bypass on the other coupler to a point where both coupler faces 9 engage with the stopping block 24 extending outward from the side of the coupler pocket housing of FIG. 8, and/or the bypass 8 on each coupler engages with the stopping block 25 extending downward from the front of the coupler pocket housing f FIG. 8, thus preventing the couplers from moving too far below each other car's underframe. In this position, the locomotive can now move the rolling stock outside of the magnetic force field and drop the uncoupled car at any desired point on a model railroad layout. When the locomotive moves away from the uncoupled car as shown in FIG. 15-C, the couplers slide over each other at the bypass position 8, such that the couplers will not re-engage in coupling but, in fact, allow the uncoupled car to be left at its desired location. Since the geometrical configuration of the bypass 8 varies from one conventional coupler to another, it is essential to compatibility that the shape be adjusted, such that recoupling does not occur when the rolling stock is being moved away by the locomotive from the uncoupled car. Once the cars have been uncoupled by the delayed mechanism, the couplers return to their normal centered position within their coupler pocket housing and are ready to recouple, as shown in FIG. 15-D. In essence, this illustrates the mechanism for delayed uncoupling of the knuckle positioned magnet-actuated coupler over the specially designed double bar magnet force field.

Rolling stock derailments and inadvertent uncoupling, attributed to the uncoupling pin of the conventional coupler, is eliminated by this invention wherein neither the magnet-actuated coupler nor the conventional couplers used in the system require a pin for any operational purpose. This is accomplished by positioning a ferromagnetic element on the knuckle portion of the magnet-actuated coupler and applying a specially directed magnetic force field for full opening of the coupler to allow for delayed uncoupling. The knuckle positioned magnet-actuated coupler of this invention does not respond to a magnetic force field placed either between the rail track or to a wider magnetic force field placed directly beneath the track ties. To operate the knuckle positioned magnetic coupler, the force field is constructed with two separate bar magnets in parallel position on the outside face of each rail opposite the other to effect a wider pivot radius for opening in delayed uncoupling.

Moreover, the double bar magnet force field does not facilitate activation of any other magnet-actuated coupler for delayed uncoupling and is specific for the knuckle-positioned magnet-actuated coupler of this invention. The knuckle-positioned coupler will disengage or uncouple from conventional couplers over the outside-the-track magnetic field. Since the preferred bar magnets of this invention are sufficiently far apart on the track, and the magnetic field pull between the rails is reduced, such that rolling stock equipped with ferromagnetic wheels, axles and/or truck frames do not "wobble" in the magnetic field to the degree evidenced with prior art magnetic fields that have a bar magnet positioned either in between the rails or directly under the rail ties.

Since a large variety of "HO" gauge rolling stock is equipped with conventional hook horn type couplers, the new magnetically-automated delayed uncoupling system is desirable for combined functional compatibility in coupling, uncoupling and delayed uncoupling operations. Rolling stock currently limited to a coupler pocket housing that is designed to accept only a conventional hook type coupler, may be now easily adapted to accept the magnetic coupler of this invention. The model railroader is thus provided with more economical rolling stock since it would no longer be necessary to replace couplers to ferromagnetic axles, wheels and/or truck frames with costly substitutes. Major manufacturers of "HO" gauge rolling stock can now easily adapt their process with a minimum of investment in production setup to produce a magnetically-automated delayed uncoupling system. The knuckle-positioned magnetic coupler may be one molded piece comprising knuckle, draw bar, and leaf spring with the magnet attached later to the knuckle.

While the invention has been described with specific embodiments thereof, it will be understood that it is capable of further modification and adaptions or variations as apparent to those skilled in the model railroading art.

I claim:

1. In a magnetically-actuated uncoupling system for model railroads including (A) a coupler pocket housing of a model car and a draw bar member having means at one point for swingably connecting to the coupler housing, (B) at the other end of said draw bar, an inwardly directed hook on one side, (C) a spring urging said draw bar in the direction laterally outward from said car, (D) a curved magnetic member secured to and extending downwardly and outwardly of said draw bar in a direction opposite said hook and adapted to be attracted by a permanent magnet positioned alongside the outside of a section of train track, whereby, when a pair of adjacent cars coupled by said couplers being in a complimentary hooking engagement are pushed to a position in alignment with a pair of opposed magnets positioned alongside the outside of a section of train track said hook portions will be moved into relatively unhooked engagement to allow outward swinging and uncoupling of said couplers upon the outward attraction of said magnetic members in the direction of their respective magnets, the improvement for delayed uncoupling which comprises:

(a) said draw bar having a knuckle (4) being defined by the outer end of said draw bar and having face (9);

(b) a bypass (8) mounted on a post (7) extending downward from the draw bar; and (c) a stopping block (25) connected to and extending downward from the front of the coupler pocket housing of the car and in alignment with the bypass (8) on the draw bar of a companion coupler when the draw bar is in a full open position, whereby, when a pair of draw bars of adjacent cars are in an unhooked full open position, the bypass (8) of each car engages the stopping block (25) of the adjacent car as the cars are pushed to a desired point outside the magnetic field for delayed uncoupling.

2. The magnetically-actuated delayed uncoupling system of claim 1 which further comprises a connecting plate (23) extending from one magnet to the opposite magnet for directionally orienting the magnetic force lines outwardly over the track rail for opening the couplers to a disengaged position.

3. In a magnetically-actuated uncoupling system for model railroads including (A) a coupler pocket housing of a model car and a draw bar member having means at one point for swingably connecting to the coupler housing, (B) at the other end of said draw bar, an inwardly directed hook on one side, (C) a spring urging said draw bar in the direction laterally outward from said car, (D) a curved magnetic member secured to and extending downwardly and outwardly of said draw bar in a direction opposite said hook and adapted to be attracted by a permanent magnet positioned alongside the outside of a section of train track, whereby, when a pair of adjacent cars coupled by said couplers being in a complimentary hooking engagement are pushed to a position in alignment with a pair of opposed magnets positioned alongside the outside of said section of train track said hook portions will be moved into relatively unhooked engagement to allow outward swinging and uncoupling of said couplers upon the outward attraction of said magnetic members in the direction of their respective magnets, the improvement for delayed uncoupling which comprises:

(a) said draw bar having a knuckle (4) being defined by the outer edge of said draw bar and having a face (9);

(b) a bypass (8) mounted on a post (7) extending downward from the draw bar;

(c) a stopping block (25) connected to and extending downward from the front of the coupler pocket housing and in alignment with the bypass (8) on the draw bar of a companion coupler when the draw bar is in the full open position; and (d) connecting plate (23) extending from one magnet to the opposite magnet for directionally orienting the magnetic force lines outwardly over the track rail for opening the couplers to a disengaged position, whereby, when a pair of draw bars of adjacent cars are in an unhooked full open position, the bypass (8) of each car engages the stopping block (25) of the adjacent car as the cars are pushed to a desired point outside the magnetic field for delayed uncoupling.

4. The magnetically actuated delayed uncoupling system of claim 1 or 3 which further comprises a stopping block (24) connected to and extending outward from the side of the coupler pocket housing and in alignment with face (9) of knuckle (4) of a companion coupler when the draw bar is in the full open position, whereby, when a pair of adjacent cars are in an unhooked full open position, face (9) of knuckle (4) engages the stopping block (24) of the adjacent car as the cars are pushed to a desired location outside the magnetic field for delayed uncoupling.

* * * * *